US005788214A

United States Patent [19]

Kopp

[11] Patent Number: 5,788,214

[45] Date of Patent: Aug. 4, 1998

[54] DEVICE FOR CONNECTING A ADHESIVE FOAM CAN TO A GUN FOR APPLYING ADHESIVE FOAMS

[76] Inventor: Volker Kopp, Santisstrasse 29, CH-8133 Esslingen, Switzerland

[21] Appl. No.: 939,991

[22] Filed: Sep. 29, 1997

[30] Foreign Application Priority Data

Sep. 30, 1996 [DE] Germany ..... 196 40 251.4

[51] Int. Cl.[6] ..... F16K 51/00

[52] U.S. Cl. ..... 251/149.4; 251/149.6; 285/330; 285/913; 285/921

[58] Field of Search ..... 222/325, 145.1, 222/145.5, 145.6; 285/330, DIG. 913, DIG. 921; 251/149.4, 149.6

[56] References Cited

U.S. PATENT DOCUMENTS

| | | | |
|---|---|---|---|
| 1,572,554 | 2/1926 | Milner | 251/149.4 |
| 4,093,280 | 6/1978 | Yoshizawa et al. | 285/330 X |
| 4,955,544 | 9/1990 | Kopp | 239/304 |
| 5,330,155 | 7/1994 | Lechner | 251/149.6 |
| 5,375,893 | 12/1994 | Guest | 285/330 |
| 5,683,544 | 11/1997 | Kopp | 222/518 X |

*Primary Examiner*—Kevin P. Shaver

[57] ABSTRACT

A device for connecting a adhesive foam can to a gun for the application of adhesive foam includes fastening means for fastening the connecting device to the gun, and an external thread for fastening the connecting device to the foam can, and a closing device that makes possible, in the operating state, the escape of the adhesive foam fluid into the gun. The thread has at least two regions of different materials, a first region of a material with flexible anti-adhesion properties and a second region of a material that at least partially ensures precise mechanical guiding of the thread.

20 Claims, 1 Drawing Sheet

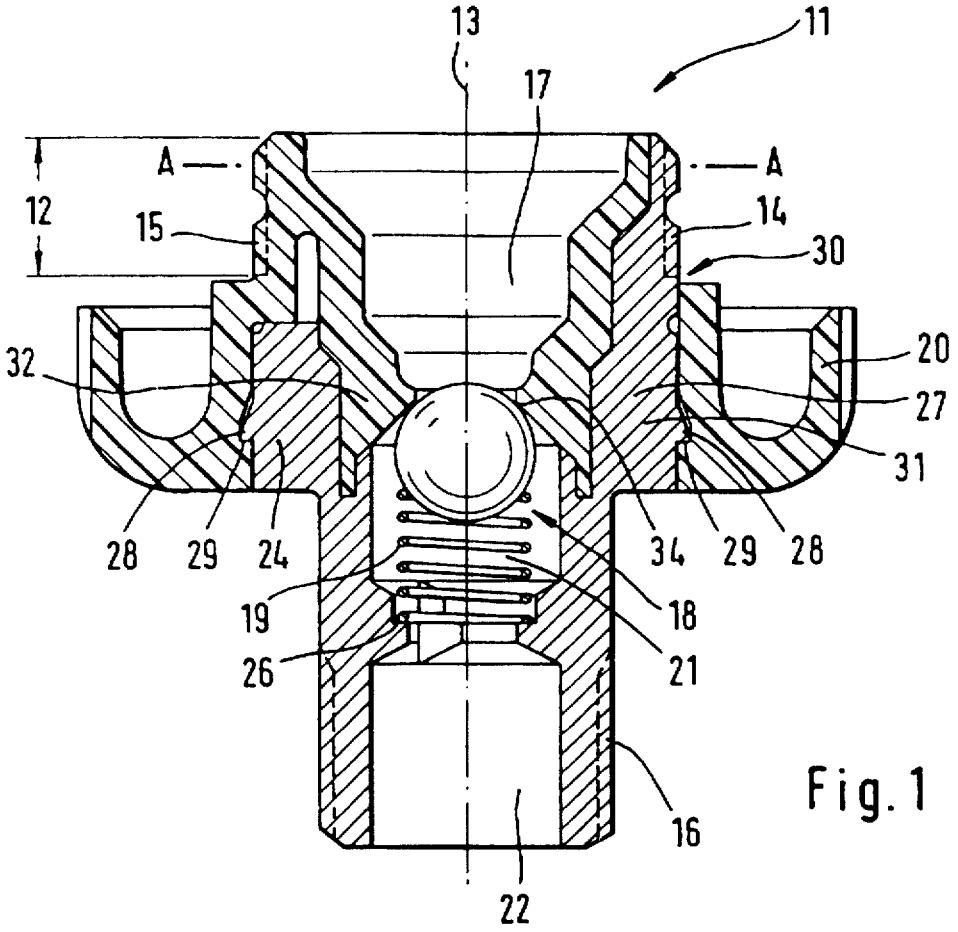
Fig. 1
Fig. 2
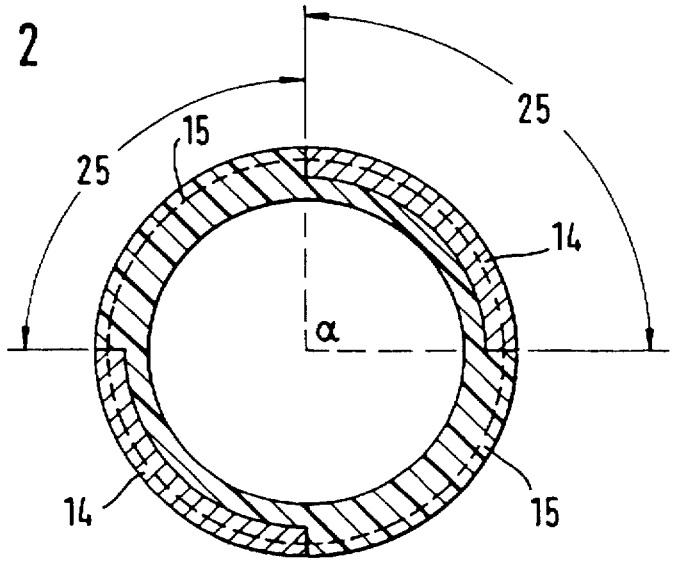

DEVICE FOR CONNECTING A ADHESIVE FOAM CAN TO A GUN FOR APPLYING ADHESIVE FOAMS

BACKGROUND OF THE INVENTION

1. Field of the Invention

This invention relates to a device for connecting a adhesive foam can to a gun for the production of adhesive foam, and more particularly, to a connecting device that includes a fastening means for fastening the device to the gun and an external thread for fastening the device to the adhesive foam can.

2. Discussion of Relevant Art

Such a connecting device is known from German Patent DE 44 26 730.

The thread by which the connecting device is attached to the adhesive foam can must be designed such that, on the one hand, the adhesive foam can does not inadvertently become detached from the connecting device, e.g. when the gun and the screwed-on adhesive foam can is shaken.

On the other hand, the external thread of the connecting device must be designed such that it is possible to unscrew the adhesive foam can again, even when the adhesive foam fluid gets between the external thread of the connecting device and the internal thread of the adhesive foam can and into the threaded region and solidifies there. This can be the case when, for example, the adhesive foam can is changed.

When fluid has entered the threaded region of the connecting device and the user tries to detach the adhesive foam can from the connecting device, the adhesive foam can is frequently levered and torn, so that on the one hand the valve can be torn out of the adhesive foam can, which can cause accidents, and on the other hand the connecting device can itself be destroyed.

SUMMARY OF THE INVENTION

The object of the present invention is to provide a connecting device of the kind described, such that an effective fastening is attained between the adhesive foam can and the connecting device, and at the same time such that the thread connecting the connective device to the adhesive foam can is prevented from becoming stuck due to adhesive fluid solidifying in the thread region, making it impossible to remove the adhesive foam can.

This object is achieved according to the invention by employing an external thread on the connecting device that includes at least two regions of different materials. The first region is made of a material that is flexible and has anti-adhesion properties. The second region is made of material that at least partially ensures precise mechanical guiding of the external thread for fastening the connecting device to the adhesive foam can.

Adhesive foam that has entered the thread region can result in a rigid, all-around adhesion, i.e., the adhesive foam can becomes stuck to the connecting device. Constructing the thread with different materials prevents this. Since regions of the thread are made of flexible, anti-adhesion material, no adhesion takes place, and the surface on which some adhesion can still take place is made considerably smaller in comparison to a thread made completely of metal.

Each turn of the thread, i.e., each full revolution around a helical line, preferably has at least a region of the material with anti-adhesion properties and a region of the material that at least partially ensures the precise mechanical guiding of the thread. It is particularly preferable for each thread turn and/or the external thread to have several of these regions. That is, at least two regions have anti-adhesion properties and at least two regions serve for the mechanical guiding of the thread.

Good releasability of an adhered thread and also a close and well guided thread that does not tilt can be attained by the alternate arrangement of the regions, especially when each region extends over the whole height of the thread and is arranged on a circular arc defined by the angle $\alpha$ of $90°\pm50°$. How the individual regions are to be configured of course depends on the respectively chosen materials that ensure the mechanical guiding and/or the anti-adhesion properties. The regions can also be defined by different angles of the circular arc according to the materials that are chosen.

It is also possible for several whole thread turns to be of the same material and border on several thread turns of the other material.

Plastic, in particular, has been found to be useful as the material with anti-adhesion properties due to its easy processing, low costs and low density.

For weight reduction and for simpler production, it is recommended to make a portion of the device body of plastic, as well as the anti-adhesion region of the thread. The thread region with anti-adhesion properties is preferably a part of the plastic portion.

Using plastic makes the gun lighter in the operating state, and handling is thus improved, particularly in situations in which the user must operate the gun with an outstretched arm.

It is advantageous to make the region of the thread that predominantly assumes the function of mechanically guiding the thread, of metal, particularly brass, in order to ensure the required mechanical stability of the external thread. It is particularly advantageous to make the metal region of the thread as a portion of a metallic part that forms a part of the device body and that is shaped such that a positively locking and frictionally locking connection with the plastic portion is effected.

Advantageously, for this purpose, this metallic part also includes the means for attaching the connecting device to the gun, e.g., a metallic external thread that serves to connect with a corresponding internal thread in the housing of the gun.

This embodiment makes possible, on the one hand, a simple production of the parts, and the assembly of the connecting device by simply clipping the plastic part onto the metallic part, which has a compression spring and nonreturn valve ball, thus ensuring the required mechanical strength from the metallic part and also attaining a weight reduction due to the plastic part.

BRIEF DESCRIPTION OF THE DRAWINGS

The invention will now be described with reference to a preferred embodiment, taken together with the drawing, in which:

FIG. 1 shows a section through the device for connecting a adhesive foam can to a gun for the application of adhesive foam, and FIG. 2 shows a view according to a section A—A in FIG. 1.

DETAILED DESCRIPTION OF PREFERRED EMBODIMENTS

The device (11) serves to connect a adhesive foam can (not shown in FIG. 1) to a gun (likewise not shown). For this purpose, the device (11) has means (14, 15, 20) for fastening the adhesive foam can and means (16) for fastening the gun.

When the adhesive foam can is screwed on, a space (17) is filled with the adhesive foam fluid, and the nonreturn valve ball (18) is pressed downward out of its closing position by the pressure, against the force of the spring (19), so that the fluid flows through the passage bore (21) and the outlet space (22) and enters the gun.

The connecting device (11) is screwed by its external thread (16) to a corresponding internal thread of the gun.

The external thread (16) is a portion of a brass part (31). The brass part (31) is substantially cylindrical in its lower region, and has in its interior bores (21, 22). A compression spring (19) is arranged in the passage bore (21). The compression spring (19) is situated with one side on a shoulder (26) of the passage bore (21).

On the right-hand side in FIG. 1, the metallic part (31) has a region (27) that includes a thread region (14). The thread region (14), of brass, extends over an angle of 90° on the circular arc (25), as shown in plan in FIG. 2, and over the entire height of the thread (14, 15).

The region (27) on the upper right and also a region (24) on the upper left of the metallic part (31), respectively, have a lug (28) that engages into a corresponding recess (29) in the collar (20).

The connecting device (11) also includes a plastic part (32) that has a circumferential collar (20) receiving the round collar of the adhesive foam can. The plastic part (32) has a thread region (15) on the left-hand side in FIG. 1. As can be seen from FIG. 2, the plastic part (32) has, in all, two thread regions (15) of plastic, respectively in the form of a circular arc (25) around the longitudinal axis (13), which regions respectively extend over an angle of about 90° and over the height of the thread (14, 15).

A step-shaped bore which forms the inlet space (17) for the fluid is provided in the plastic part (32). The nonreturn valve (18) is supported on a circumferential seating surface (34) in the closing position.

The plastic part (32) and the metallic part (31) are designed so that the plastic part (32) can be clipped onto the metallic part (31). The compression spring (19) and the nonreturn valve ball (18) are located in the bore of the metallic part (31). A positively and frictionally locking connection of the two parts is attained. The plastic part (32), together with the metallic part (31), forms the device body (30).

A first thread region (15) of a first material with anti-adhesion properties, namely plastic, is shown on the left-hand side of FIG. 1. The second region of the thread (14), of a second material, namely that of brass that ensures the mechanical guiding of the thread, is shown on the right-hand side of FIG. 1.

As can be seen from FIG. 2, the thread has four different regions, namely two regions (15) of a material with anti-adhesion properties, and two regions (14) of the material that ensure the mechanical guiding of the thread. Each region (14, 15) extends over a circular arc (25), respectively over an angle of 90°, with like regions being arranged opposite each other.

On changing the adhesive foam can, fluid enters the region of the thread (14, 15). However, no adhesion to the internal thread of the adhesive foam can takes place in the thread regions (15) since the plastic has anti-adhesion properties.

Since the effective adhesion surface is made smaller, it is possible to unscrew or lever off the adhesive foam can from the connecting device even if fluid has entered the thread space. Also, the force required to unscrew a can when fluid has entered the thread space is reduced. The whole gun, with connecting device and adhesive foam can is subject to much less wear when the adhesive foam can is changed frequently, because levering and tearing due to the expenditure of full force are no longer required.

I claim:

1. A device for connecting a adhesive foam can to a gun for application of adhesive foam, comprising:

fastening means (16) for fastening said connecting device to said gun, an external thread (14, 15) for fastening said connecting device to said adhesive foam can, and a closing device (18, 19) that in an operating state enables escape of said adhesive foam into said gun, wherein said external thread (14, 15) includes at least two regions of different materials, comprising:

a first region (15) of a first material with flexible anti-adhesion properties, and a second region (14) of a second material that at least partially ensures precise mechanical guiding of said external thread (14, 15).

2. The connecting device according to claim 1, wherein each thread turn of said external thread (14, 15) has at least one region of said first material and at least one region of said second material, which second material is non-flexible.

3. The connecting device according to claim 1, wherein each thread turn of said external thread (14, 15) has two regions of said first material, and two regions of said second material.

4. The connecting device according to claim 3, wherein said first regions and said second regions are arranged alternately.

5. The connecting device according to claim 4, wherein at least one of said first region and said second region has a height (12) that corresponds in height to said external thread (14, 15).

6. The connecting device according to claim 4, wherein said first region and said second region are alternately arranged on a periphery of a circle around a longitudinal axis (13) of said connecting device.

7. The connecting device according to claim 6, wherein each of said first region (15) and said second region (14) correspond to a circular arc (25) with an angle of 90 degrees ±50 degrees.

8. The connecting device according to claim 1, wherein said first region (15) is comprised of plastic.

9. The connecting device according to claim 1, further comprising a device body (30) including a plastic part (32).

10. The connecting device according to claim 9, wherein said first region (15) comprises a portion of said plastic part (32) of said device body (30).

11. The connecting device according to claim 1, wherein said second region (14) is comprised of metal.

12. The connecting device according to claim 1, further comprising a device body (30) including a metallic part (31).

13. The connecting device according to claim 12, wherein said second region (14) comprises a portion of said metallic part (31) of said device body (30).

14. The connecting device according to claim 13, wherein said metallic part (31) of said device body (30) is comprised of brass.

15. The connecting device according to claim 12, wherein said device body (30) includes a plastic part (32) clipped onto said metallic part (31).

16. The connecting device according to claim 1, further comprising a collar (20).

17. The connecting device according to claim 1, wherein said fastening means (16) comprises an external thread (16).

18. The connecting device according to claim 17, wherein said external thread (16) is comprised of metal.

19. The connecting device according to claim 18, further comprising a device body (30) including a mechanical part (31), wherein said external thread (16) comprises a metallic portion of said metallic part (31) of said device body (30).

20. The connecting device according to claim 9, further comprising a collar (20) that comprises a portion of said plastic part (32).

* * * * *